United States Patent [19]

Roy

[11] 4,303,168

[45] Dec. 1, 1981

[54] LINERLESS CLOSURE WITH CRUSHABLE SEAL

[75] Inventor: Gerald L. Roy, Lancaster, Pa.

[73] Assignee: Kerr Glass Manufacturing Corporation, Lancaster, Pa.

[21] Appl. No.: 808,480

[22] Filed: Jun. 21, 1977

[51] Int. Cl.[3] ..... B65D 41/04

[52] U.S. Cl. ..... 215/344; 215/351; 215/DIG. 1

[58] Field of Search ..... 215/344, 343, 345, 341, 215/329, 351, 352, DIG. 1

[56] References Cited

U.S. PATENT DOCUMENTS 3,255,909 6/1966 Miller ..... 215/329
3,595,418 7/1971 Adcock ..... 215/344

FOREIGN PATENT DOCUMENTS 162520 3/1953 Australia ..... 215/344
209870 1/1956 Australia ..... 215/DIG. 1

OTHER PUBLICATIONS

Shackleton (Abstract) of Ser. No. 743,769, filed Apr. 25, 1947, published Nov. 22, 1949, in vol. 628, p. 1201.

*Primary Examiner*—Herbert F. Ross
*Attorney, Agent, or Firm*—Fitch, Even, Tabin, Flannery & Welsh

[57] ABSTRACT

A polypropylene closure for glass containers. The enclosure has a top end wall and a depending annular skirt wall. A substantially rigid V-shaped sealing fin of triangular cross-section projects downwardly from the top end wall to engage the finish of a glass container neck in sealing relation when the closure is applied to the container. The closure is threaded onto the container neck and the sealing fin comes into contact with the finish. The application of additional closure torque causes the sealing fin to deform and be crushed.

6 Claims, 3 Drawing Figures

LINERLESS CLOSURE WITH CRUSHABLE SEAL

The present invention relates generally to a linerless closure and more particularly relates to a one-piece, plastic, linerless closure used in combination with a glass container whereby a sealing engagement between the closure and the container is effected by compression and deformation of a portion of the closure against the finish of the container.

A plastic, linerless closure which would be effective to seal a glass container from leakage of liquid contents has long been a goal in the container industry. A number of linerless closures have been developed and many patents are directed to linerless closures; however, the previously developed linerless closures have not been wholly effective to seal glass containers. Glass containers have relatively rough finishes which are those portions of the containers defining their mouths and engaged by sealing portions of closures. To be completely effective, it is necessary that the initial seal provided between the closure and the container finish be liquid-tight and, then, that the seal does not deteriorate during storage due to plastic flow of the sealing portion of the closure.

Many of the linerless closures available commercially rely upon deflection of a flexible fin depending from the closure. The lateral flexing movement of the fin tip is designed to cause the tip of the fin to move into sealing engagement with a flat or downwardly slanted conical container finish. An example of this type of linerless closure is found in U.S. Pat. No. 3,255,909 to Miller et al. The problem with this type of linerless closure is that the sealing portion of the closure remains under compressive loading and after storage for a period of time the plastic tends to relieve the compression by cold flow movement. The seal is then either lost and the container tends to leak or the unloading torque to release the closure becomes very low.

Rather than flexing a bendable sealing fin, the closure of the present invention uses a substantially rigid sealing fin with a sharp pointed sealing end which is to be swedged and flattened into tight sealing relation with imperfections in the glass closure finish. The design of the sealing fin is such that the initial swedging and flattening of the sealing fin terminates the compressive loading and there is no tendency for further cold flow movement to relieve the compression or reduce the unloading torque. The sealing fin is formed with a sharp radius end 18 about 0.005 inches or less to provide loading forces of about 18,000 to 24,000 psig thereon with the usual capping machine torques of about 15 to 25 pounds. These loading forces are sufficient to swedge and flatten the sealing tip surface to a width of about 0.20 inches and to leave a residual force loading of about 1000 to 2000 psig at the sealing tip surface of 0.020 inches in width.

While the plastic flow eliminates the decay of loading being experienced with the flexed sealing rings of the prior art, the rigidity of the sealing ring and the closure material caused other failures to occur. More specifically, the rigid sealing fin exerted sufficient force on the top end wall of the closure to fracture the same in some instances during the capping operation. Also, the high forces being applied at the container screw threads caused the skirt end walls to flare radially outwardly. Apparently, the flexible sealing fins of the prior art linerless closures provide sufficient give to reduce the force loadings on the top end walls or the skirt walls of those kinds of closures. The present invention is specifically directed to providing an improved design for the manufacture of a linerless closure whereby a seal can be effected between the closure and a glass container having either an inwardly or outwardly slanted finish or a flat or horizontal finish.

Accordingly, it is a principal object of the present invention to provide a glass container closure which will be highly effective in providing a liquid-tight seal both upon the initial application of the closure to the container and during storage and reuse of the container.

It is another object of the present invention to provide a linerless closure for use in sealing a glass container which has sufficient strength to withstand the forces applied when crushing a portion of the closure to physically deform the portion and cause flow of the plastic into imperfections in the finish of the glass container.

A still further and general object of the invention is to provide an improved linerless closure and container combination.

Additional objects and advantages of the present invention will be more apparent from the following detailed description and the accompanying drawing wherein.

Figure 1:
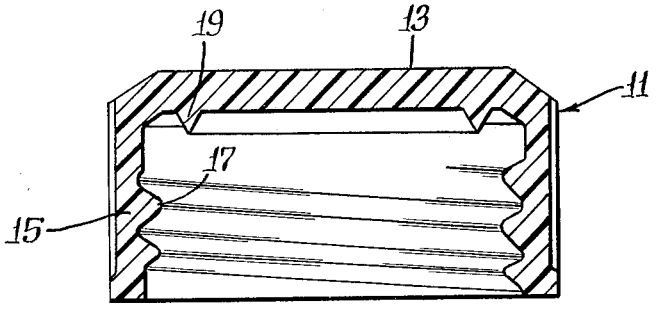
FIG. 1 is a sectional elevational view of the closure of the present invention.

Referring now to the drawings, in FIG. 1 there is shown a closure generally designated at 11 having a top end wall 13 and a depending annular skirt wall 15. Integral screw threads 17 on the interior of the skirt wall interengage with external threads 23 on the neck 21 of a glass container for securing the closure to the container. A substantially rigid, annular, V-shaped sealing fin 19 of triangular cross-section depends downwardly from the top end wall 13 to engage the finish 25 of the container neck in sealing relation when the closure is applied to the container. The sealing fin 19 is defined by two downwardly tapering walls which are concentric with the skirt and intersect at an angle indicated at A in FIG. 2. Preferably, the fin walls are symmetrical about a cylinder concentric with the skirt, that is, if extended beyond the radius end, they would intersect such a cylinder at equal angles. The axis of the sealing fin is perpendicular to the top end wall and parallel to the skirt wall. The apex angle of the fin, designated angle A in FIG. 2, is from about 40° to about 60°.

Figure 2:
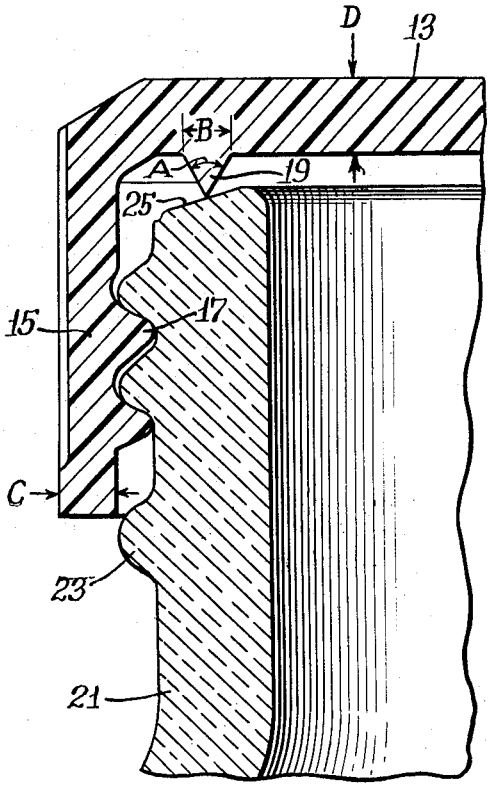
FIG. 2 is an enlarged sectional elevational view, partially broken away, showing the closure partially engaged with the container.
Figure 3:
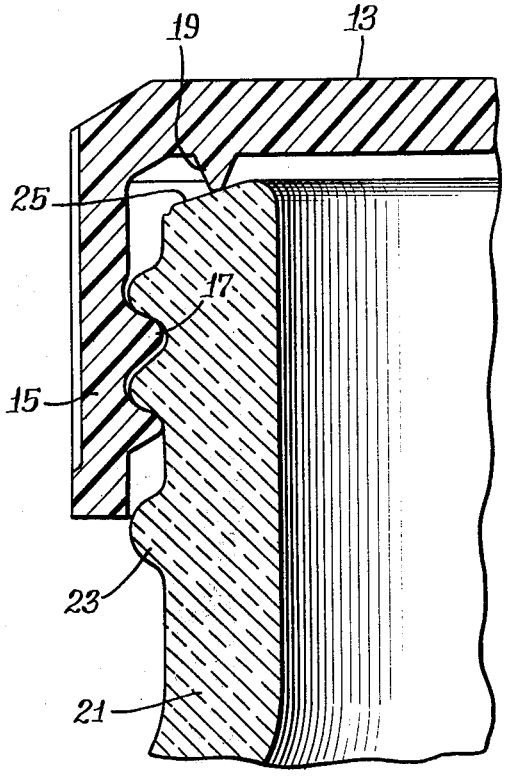
FIG. 3 is a view similar to FIG. 2 showing the closure container combination with the closure being in full sealing position with the container neck.

As shown in FIGS. 2 and 3, the container neck 21 terminates at its upper end in a downwardly and inwardly tapering, frusto-conical finish 25. It should be understood, however, that the closure of the invention is suitable for use with horizontal or flat finishes so long as the finish has no imperfections greater than 0.009 inches in depth. The closure is found to operate most satisfactorily with a tapered finish having a taper angle of from 0° to about 45° from horizontal.

The base of the sealing fin 19, dimension B in FIG. 2, is preferably in the range of from about 0.04 to about 0.06 inch. The center line of the sealing fin 19 is located at a distance no greater than about 0.12 inch and preferably is within the range of from about 0.08 inch to about 0.12 inch from the innermost surface of the skirt wall 15. The tip of the sealing fin 19 has a radius of less than about 0.005 and the radius is preferably from about 0.003 to about 0.005 inch. The above dimensions in respect to the base diameter, apex angle, tip radius and location of the sealing fin 19 are critical to provide the benefits of the invention in the intended manner as described more fully hereinafter.

As the closure 11 is threaded onto the container neck 21 and the sealing fin 19 comes into contact with the finish 25, the application of additional closing torque causes the sealing fin 19 to deform and be crushed to the position shown in FIG. 3. Because of the relationship of the various construction parameters of the sealing fin 19, the application of a high torque load during the sealing process causes the tip of sealing fin 19 to be crushed and to deform into the imperfections of the finish 25 of the container neck. There is no tendency for the sealing fin 19 to be pushed upwardly or outwardly from the surface of the finish 25 so long as the taper angle does not exceed about 45°.

Tapered finished (either toward the center of the container or toward the outside of the container) serves to center the sealing ring on the closure and thus properly locate the closure threads in relation to the container threads. This centering action also enhances the uniformity of the vertical forces which are generated when the cap is tightened.

The compressive strength, which is a measure of the deformation point of a plastic, is an important parameter in selecting a material for use in the linerless closure of the present invention. The application of a closing torque in the range of from about 15 to about 25 inch-/pounds for a 28 mm closure is sufficient to cause initial loading forces on the tip of sealing fin 19 in the range of from about 18,000 to about 24,000 psig. Such compressive forces are extended to exceed the compressive strength of the sealing fin and cause the plastic to be crushed and to flow into the imperfections of the glass. To provide the required sealing fin point deformation of the present invention the plastic must have a compressive strength of less than about 15,000 psig and preferably within the range of from about 5,000 to about 10,000 psig. As the plastic deforms, the width of the sealing tip of the sealing fin 19 increases from about 0.003 to 0.005 inch to about 0.020 to 0.025 inch and the residual load then falls to between about 1,000 and 2,000 psig which corresponds to a residual torque of between about 6 and 8 inch pounds. This is below the compressive strength and the plastic stops deforming. Since the deformation stops due to the increase in width of the sealing tip, the sealing pressure remains and the residual or removal torque is maintained throughout the life of the package.

As indicated hereinabove, it has been determined that, to be suitable for use as the plastic material in the closure design of the present invention, the material should have a compressive strength of less than about 15,000 psig to permit plastic deformation at moderate closure torque loadings of from about 18 to 22 inch-/pounds. It is also important that the plastic material have a flexural stiffness of at least 175,000 psi and preferably in the range of 180,000 to 230,000. The plastic material should also have a Shore D hardness in the range of from 70 to 90. Polypropylene is the only plastic material presently available which meets the requirements and has been found suitable for use as the closure of the present invention. Polystyrene, for example, has a compressive strength of 11,000–16,000 and might be thought to be suitable since it would deform under the closure loads generated by the present invention. However, polystyrene is too hard and does not conform to the irregularities, such as dips or pebbly sealing surfaces, in the finish. High density polyethylene has desirable compressive strength and hardness, but is too flexible for use.

The capping machines generate high compressive forces during crushing of the rigid sealing fin point and these high forces are also present in the top end wall 13 and at a lower portion of the skirt wall 15. This tends to cause rupture of the top end wall 13 and flaring of the skirt wall 15. In accordance with the present invention, the skirt wall is made considerably thicker than the usual thickness of about 0.042 inch and the forces generated do not flare the thicker skirt wall. Likewise, the top end wall 13 is considerably thicker than the usual 0.60 inch to withstand the high loadings applied thereto during the capping operation. More specifically, it has been determined that dimension C as shown in FIG. 2, should be at least about 0.048 inches and that dimension D should be at least about 0.070 inches. While both dimension C and dimension D can be greater than the specific thickness, the economic advantages of the linerless closure of the invention are lost if dimension C or dimension D exceeds by any substantial amount the specified thickness.

The closure construction set forth in the present invention is suitable for the manufacture of closures having a diameter of up to about 45 mm. Larger diameter glass container necks have variations in dimensions which are too great to permit use of the crushable feature of the present invention for effecting a seal between a linerless closure and the container neck finish.

It is obvious that many changes and modifications may be made in the container closure of the invention without departing from the spirit and scope which is to be limited only to the following claims.

What is claimed is:

1. A linerless closure for sealing a glass finish on a glass container having an external screw thread for threadably receiving said closure, said closure comprising a one piece body of polypropylene having a top end wall for extending across the open top of a container, a dependent skirt wall integrally joined to said top end wall about the outer circumference of said top end wall, an integral screw thread formed on the inner side of said skirt wall for threading engagement with the external screw thread on a glass container, a rigid V-shaped sealing fin projecting downwardly from said top end wall, said V-shaped sealing fin being substantially triangular shaped in cross section and being rigid to transmit closure torque loading forces applied thereto to said top end wall, said V-shaped sealing fin having a lower sealing end for sealing engagement with the container finish, said end having a radius of 0.005 inch or less than 0.005 inch and having upwardly extending walls defining an apex angle within the range of 40° to 60° and having a cross-sectional width in the range of 0.04 to 0.06 inch at the juncture of the fin of said top end wall, and being formed of polypropylene having a compressive strength of less than about 15,000 psig to define a crushable end to flatten and to cold flow and to permanently deform into a width at least several times greater than 0.005 inch with conventional closure torques and thereby to seal with imperfections in said finish, said top end wall having a thickness of at least about 0.070 inch from the juncture of said skirt wall and top end wall to at least the sealing ring diameter and said skirt wall having a thickness of at least 0.048 inch to withstand compressive forces in the range of 18,000 to 24,000 psig generated during the crushing and permanently deforming of the sealing fin by automatic capping machines, said crushable end being rigid and non-bending, said threads and said skirt wall being formed of polypropylene having a flexural stiffness of at least 175,000 psi to prevent flaring of the skirt wall when permanently deforming said crushable end against said container finish, said V-shaped annular sealing ring being the only sealing surface on said closure for sealing with said container finish.

2. A linerless closure in accordance with claim 1 wherein said end of said sealing fin has a radius of from about 0.003 to about 0.005 inch.

3. A linerless closure in accordance with claim 1 wherein the center line of said sealing fin is located at a distance of from about 0.08 to about 0.12 inch from the innermost surface of said skirt wall.

4. The combination of a linerless closure and a container comprising a container made of glass and having a finish at an angle of from 0° to about 45° to the horizontal, a closure comprising a one piece body of polypropylene having a top end wall for extending across the open top of said container, a dependent skirt wall integrally joined to said end wall about the outer circumference of said top end wall, an integral screw thread formed on the inner wall of said skirt wall for threading engagement with the external screw thread on said container, a rigid V-shaped, annular sealing fin projecting downwardly from said top end wall, said V-shaped sealing fin being triangular shaped in cross section and being rigid to transmit closure torque loading forces applied thereto to said top end wall, said V-shaped sealing fin having a lower sealing end for sealing engagement with the container finish, said end having a radius of less than 0.005 inch and having an apex angle in the range of about 40° to 60° and having a cross-sectional width in the range of about 0.04 to 0.06 inch at the juncture with said top end wall, said sealing fin being formed of polypropylene having a compressive strength of less than about 15,000 psig to define a crushable end to flatten and to cold flow to a permanently defomed width at least several times greater than 0.005 inch and thereby to grind into and to seal with imperfections in said finish, said crushable end being rigid and non-bending, said crushable end being releasable from said finish with conventional removal torques, said top end wall having a thickness of at least 0.070 inch and said skirt wall having a thickness of at least 0.048 inch to withstand the compressive forces in the range of 18,000 to 24,000 psig generated during the crushing of the sealing fin by automatic capping machines, said skirt wall being formed of polypropylene having a flexural stiffness of at least 175.000 psi to prevent flaring of said skirt wall when permanently deforming said crushable end against said container finish, said V-shaped annular sealing ring being the only sealing surface on said closure for sealing with said container finish.

5. The combination of claim 4, wherein said end of said sealing fin has a radius of from about 0.003 to about 0.005 inch.

6. The combination of claim 4, wherein the center line of said sealing fin is located at a distance of from about 0.08 to about 0.12 inch from the innermost surface of said skirt wall.

* * * * *

UNITED STATES PATENT AND TRADEMARK OFFICE

CERTIFICATE OF CORRECTION

PATENT NO. : 4,303,168

DATED : December 1, 1981

INVENTOR(S) : Gerald L. Roy

It is certified that error appears in the above—identified patent and that said Letters Patent is hereby corrected as shown below:

Column 1, line 50, "18" should be --of--.

Column 5, line 27, insert --top-- after "said".

Signed and Sealed this

*Twenty-sixth* Day of *October 1982*

[SEAL]

*Attest:*

GERALD J. MOSSINGHOFF

*Attesting Officer*

*Commissioner of Patents and Trademarks*